US008236431B2

(12) United States Patent
Mukkamala

(10) Patent No.: US 8,236,431 B2
(45) Date of Patent: Aug. 7, 2012

(54) HOLLOW ORGANIC PIGMENT CORE BINDER COATED PAPER AND PAPERBOARD ARTICLES AND METHODS FOR MAKING THE SAME

(75) Inventor: Ravi Mukkamala, Lansdale, PA (US)

(73) Assignee: Rohm and Haas Company, Philadelphia, PA (US)

( * ) Notice: Subject to any disclaimer, the term of this patent is extended or adjusted under 35 U.S.C. 154(b) by 993 days.

(21) Appl. No.: 11/901,337

(22) Filed: Sep. 17, 2007

(65) Prior Publication Data

US 2008/0081175 A1 Apr. 3, 2008

Related U.S. Application Data

(60) Provisional application No. 60/849,261, filed on Oct. 3, 2006.

(51) Int. Cl.

| | |
|---|---|
| ***B32B 5/16*** | (2006.01) |
| ***B32B 29/00*** | (2006.01) |
| ***C08J 9/16*** | (2006.01) |
| ***C08J 9/18*** | (2006.01) |
| ***C08J 9/28*** | (2006.01) |

(52) U.S. Cl. ..... 428/537.5; 428/402; 521/56; 521/59; 521/60; 521/65

(58) Field of Classification Search ..... None
See application file for complete search history.

(56) References Cited

U.S. PATENT DOCUMENTS

| | | | | |
|---|---|---|---|---|
| 4,427,836 | A * | 1/1984 | Kowalski et al. | 525/301 |
| 5,157,084 | A | 10/1992 | Lee et al. | |
| 5,494,971 | A | 2/1996 | Blankenship | |
| 5,521,253 | A | 5/1996 | Lee et al. | |
| 5,989,630 | A | 11/1999 | Schlarb et al. | |
| 6,020,435 | A | 2/2000 | Blankenship et al. | |
| 6,139,961 | A | 10/2000 | Blankenship et al. | |
| 7,645,815 | B2 * | 1/2010 | Hermes et al. | 523/172 |

FOREIGN PATENT DOCUMENTS

| | | | |
|---|---|---|---|
| EP | 1 197 503 | A | 4/2002 |
| EP | 1 602 783 | A | 12/2005 |
| EP | 1 630 289 | A | 3/2006 |

* cited by examiner

*Primary Examiner* — Sheeba Ahmed
(74) *Attorney, Agent, or Firm* — Andrew E. C. Merriam

(57) ABSTRACT

A coating for paperboard comprises an aqueous dispersion of a hollow core binder comprising a first polymer that, when dry, has at least one void, the first polymer being substantially encapsulated by at least one second polymer having a glass transition temperature ($T_g$) ranging from more than −15° C. and up to and including 30° C., wherein the weight ratio of the said second polymer to the said first polymer ranges from 1:1 to 4:1. One or both of the first polymer and the second polymer may be formed from, as polymerized units, at least one ethylenically unsaturated monomer. The hollow core binder allows for glossy, bright and smooth paperboard coatings while reducing the amount of binder and opacifying pigment necessary to achieve such coating properties. The present invention also provides coated paperboard articles, as well as paper and paperboard that is made from a mixture of pulp with the inventive hollow core binder.

9 Claims, No Drawings

HOLLOW ORGANIC PIGMENT CORE BINDER COATED PAPER AND PAPERBOARD ARTICLES AND METHODS FOR MAKING THE SAME

BACKGROUND OF THE INVENTION

This application claims the benefit of priority under 35 U.S.C. §119(e) of U.S. Provisional Patent Application No. 60/849,261 filed on Oct. 3, 2006.

The present invention relates to methods of coating paperboard and of making paper with hollow core binders, and to the coated paper and paperboard articles formed by such methods. More particularly, the present invention relates to methods of coating paperboard and of making paper with an aqueous dispersion comprising binder coated void containing polymeric pigment particles in which the binder has a glass transition temperature sufficient to provide coating films, provide in-process durability, and, thereby, enable high gloss paperboard coatings and a low cost approach to making paper and coating paperboard.

To enable strong paperboard coatings of a desirable opacity and brightness, the artisan would conventionally use more binder and more titanium dioxide. However, intense competition in the paper making and paperboard coating industries limits the amount of costly binder and titanium dioxide that can be used. Accordingly, lower amounts of conventional binder and titanium dioxide are needed in a paperboard coating to realize a performance similar to existing paperboard coatings, thereby reducing coating and paper making cost for the paper(board) manufacturer.

In addition, the energy requirements of processing conventional paperboard coatings have proven costly, especially where a mid-gloss or high-gloss coating is desired. Plastic pigments such as solid polystyrene beads, hollow polymer and organic opacifier pigments, have been used to increase opacity and gloss in paper and paperboard coatings. However, such coatings in are known for some potential drawbacks such as reduced coating strength, increased coating and print mottle, and higher costs.

Binder coated hollow sphere pigments provide both binding and light scattering characteristics, thus enabling simplified formulations of coating and wet papermaking materials. For example, U.S. Pat. No. 6,139,961, to Blankenship et al., discloses aqueous dispersions of water-insoluble core/sheath polymer particles used to coat paper and paperboard. In the core/sheath particles, the core contains one or more void encapsulated by a first shell polymer having a glass transition temperature $T_g$ greater than 50° C.; further, polymerized on the first shell is a second shell polymer having a glass transition temperature of −15° C. to −50° C. The second shell of the core/sheath polymer particles comprises at least 15 wt. % of the total weight of the first shell polymer and the second shell polymer; and the weight ratio of the core polymer to the first shell polymer is from 1:2 to 1:100. The Blankenship et al. dispersions provide opacity to coatings containing them. However, the coatings of Blankenship et al. provide inadequate strength to protect the coated article from damage during processing and do not provide an acceptably high gloss coating. As a result, one must use additional binder and opacifying pigment to achieve acceptable coating strength and gloss, which can be very expensive.

The Applicant has endeavored to solve the problem of providing a low cost, mid-gloss or high-gloss paperboard coating that can withstanding the processing of paperboard coatings.

SUMMARY OF THE INVENTION

The methods of the present invention comprise applying a coating composition to a paperboard substrate, the coating composition comprising an aqueous dispersion of one or more hollow-core binder of a first polymer containing one or more void, the first polymer being substantially encapsulated by one or more second polymer, wherein the second polymer has a glass transition temperature ($T_g$) ranging from more than −15° C. and up to and including 30° C., for example, up to 25° C., and, further, wherein the weight ratio of second polymer to the first polymer ranges from 1:1 to 4:1, and drying and/or curing to form a coating. One or both of the first and the second polymer is formed from, as polymerized units, one or more ethylenically unsaturated monomer. Preferably, the first polymer is a multistage polymer formed from, as polymerized units, one or more ethylenically unsaturated monomer and having a void containing core stage, such as an alkali swellable or an alkali hydrolysable polymer. Preferably, the second polymer is formed from, as polymerized units, one or more ethylenically unsaturated monomer, or, more preferably, one or more mono-ethylenically unsaturated monomer. The second polymer may also be a condensation polymer. The $T_g$ of the first polymer is 50° C. or more, and is, preferably, 75° C. or more. Preferably, the weight ratio of second polymer to the first polymer ranges from 2:1 to 3:1.

Alternatively, the methods of the present invention comprise mixing a composition comprising an aqueous dispersion of one or more hollow-core binder in accordance with the present invention with cellulosic fiber pulp before or during the formation of a sheet or board of the said paper or paperboard, forming the sheet or board, such as by calendering or pressing, and, drying to form a paper, a paper laminate or a paperboard article.

In the methods of the present invention, the compositions may further comprise binders chosen from paper pulp binders and coating binders. The compositions of the present invention may, additionally, comprise opacifying pigments, fillers, such as titanium dioxide, calcium carbonate, or combinations thereof.

The compositions provide a pinhole-free coating on paperboard articles and enable preparation of substrate having the opacity and brightness of a desired coating. Further, the strength and light-scattering of paperboard coatings and paper articles made with the coating composition of the present invention is increased relative to coatings having the same amount of binder and titanium dioxide.

Additionally, the present invention provides coated paperboard articles having thereon the coating formed from the compositions of the present invention. Further, the present invention provides paper, laminate paper or paperboard made with the compositions of the present invention. In the case of laminate paper, one or more of the layers of the laminate comprises the hollow core binder of the present invention.

All ranges recited are inclusive and combinable. For example, average particle diameters that range 200 nanometers (nm) or more and that may range up to 5000 nm, preferably up to 1500 nm, more preferably, 300 nm or more or, more preferably, up to 1000 nm would include average particle diameters of from 200 nm to 5000 nm, or of from 300 to 5000 nm, or of from 200 nm to 1000 nm, or of from 300 nm to 1000 nm, or of from 200 nm to 1500 nm, or of from 300 nm to 1500 nm.

Unless otherwise indicated, all temperature and pressure units are standard temperature and pressure (STP).

All phrases comprising parentheses denote either or both of the included parenthetical matter and its absence. For example, the phrase "(meth)acrylate" includes, in the alternative, acrylate and methacrylate; likewise, the phrase "(co) polymer" refers, in the alternative, to a polymer or a copolymer.

As used herein, unless otherwise indicated, the term "average particle size" means the particle size as determined by light scattering using a, BI-90 Plus instrument from the Brookfield Instrument Company, Middleboro, Mass.

As used herein, the term "component" means a composition comprising the specified ingredient. For example, an initiator component may simply be an initiator or it may comprise an initiator pre-dispersion of initiator, aqueous liquid and emulsifier or surfactant.

As used herein, unless otherwise indicated, the term "Glass transition temperature" or $T_g$ refers to the quantity calculated by using the Fox equation (T. G. Fox, *Bull. Am. Physics Soc.*, Volume 1, Issue No. 3, page 123(1956)). For copolymers comprising the polymerization product of more than two different monomers, the calculation may be expressed as:

$$1/T_g=\Sigma[w(Mi)/T_g,(Mi)],$$

where w(Mi) is the weight fraction of each monomer, and $T_g$,(Mi) the glass transition temperature of the homopolymer of Mi. In the case of any multistage polymer, the recited $T_g$ represents the $T_g$ calculated from all monomers used to make the entire multistage polymer.

As used herein, the term "Experimental $T_g$" refers to the quantity measured via differential scanning calorimetry (DSC) at a rate of heating 20° C. per minute, the $T_g$ taken at the midpoint of the inflection or peak. If an "Experimental $T_g$" is recited for any multistage polymer, the recited Experimental $T_g$ represents the $T_g$ of the outer stage of the multistage polymer. Unless otherwise indicated, the $T_g$ of polymers other than addition polymers, e.g. condensation polymers such as polyesters, is an Experimental $T_g$.

As used herein, the term "high solids content" refers to solids contents of greater than 50 wt. %, and preferably, greater than 60 wt. %.

As used herein, the term "(meth)acrylate" means acrylate, methacrylate, and mixtures thereof and the term "(meth) acrylic" used herein means acrylic, methacrylic, and mixtures thereof.

As used herein, unless otherwise indicated, the phrase "molecular weight" refers to the weight average molecular weight as measured by gel permeation chromatography (GPC) against a polyacrylic acid (PAA) standard of a copolymer that is hydrolyzed in KOH.

As used herein, the term "pigment volume concentration" or PVC refers to the quantity calculated by the following formula:

$$PVC(\%)=(\text{volume of pigment(s)}+\text{volume extender(s)})\times 100\text{total dry volume of paint}$$

As used herein, the term "substantially encapsulating" means that greater than 50% of the surface area of the encapsulated particle, e.g. (co)polymer, is covered by the encapsulant, e.g. first or second polymer.

As used herein, the term "void" refers to a polymer-free space, which may be filled with air or another gas when the substance containing it is dry.

As used herein, the term "volatile organic compound" or (VOC) is defined as a carbon-containing compound that has a boiling point below 280° C. at atmospheric pressure.

As used herein, the term "wet-end" or "wet-end processing" refers to the part of paper or paperboard processing during which a predominantly cellulosic fiber pulp slurry is formed into a wet sheet on a paper machine by techniques that are known in the art.

As used herein, the phrase "wt. %" stands for weight percent.

In the hollow core binder of the present invention, the first polymer comprises, when dry, at least one void having a diameter of 50 nm or more, or up to 1500 nm, preferably, 100 nm or more, and, preferably, up to 700 nm, and the second polymer substantially encapsulates the first polymer. Coating and papermaking compositions with the hollow core binder of the present invention provide coatings and paper products with strength and opacity properties comparable to coatings having up to 30 wt. % more of each of costly opacifier pigments, e.g. titanium dioxide, and binder polymer added thereto. Further, the hollow core binder compositions form films more easily and with less energy input than coatings of comparable gloss and quality, thereby enabling the provision of economical, high quality paperboard coatings and paper products, especially those having a mid-gloss or higher gloss.

The compositions of the first polymer and the second polymer are selected so as to provide durability in processing and so as to enable the formation of coatings with desirable appearance properties. Each of the first polymer and second polymer of the hollow core binder can comprise the polymerization product of one or more ethylenically unsaturated monomer, preferably one or more mono-ethylenically unsaturated monomer. Further, each of the first polymer and second polymer of the hollow core binder can, independently, comprise a multi-stage copolymer having two or more stages. The first polymer may be a condensation polymer, such as a polyester, polyurethane, polyamide or alkyd. The second polymer may comprise various binder compositions, such as styrene-butadiene copolymers. The $T_g$ of the first polymer is 50° C. or more and can range up to 150° C. Preferably, the $T_g$ of the first polymer ranges 75° C. or more or, more preferably, 80° C. or more. The $T_g$ of the second polymer ranges from above −15° C. and up to and including 30° C., for example, up to and including 25° C., preferably −5° C. or more. Preferably, the $T_g$ of the second polymer can be up to 10° C., more preferably, up to 5° C.

Preferably, the first polymer comprises a multistage copolymer having a core, wherein the core polymer or stage comprises, as polymerized units, any one or more (co)polymer in which one or more void may be formed in the polymer by known methods, including alkali swelling, alkali hydrolysis, by the removal of fugitive substances or removable porogens therefrom, by the use of blowing agents contained therein and activated after polymerization, or by the use of solvents to dissolve out void portions. Alternatively, the first polymer may comprise a single stage polymer wherein internal voids or hollow spaces may be formed by the removal of encapsulated fugitive substances or removable porogens therefrom, by the use of blowing agents to create internal voids. Accordingly, the core of a multi-stage first polymer may be comprise any swellable polymer, such as an alkali swellable polymer or solvent soluble polymer, such as polymers soluble in water or in organic solvents; likewise, a single stage first polymer or any core of a multi-stage first polymer may contain a fugitive, porogen or blowing agent substance to form one or more void.

Alkali swellable polymers may contain, as polymerized units, one or more mono-ethylenically unsaturated acid or one or more acid-free polymerized unit that is hydrolyzable and swellable in alkaline environments at temperatures above the polymer $T_g$, such as for example, (meth)acrylate esters, vinyl esters of carboxylic acids or mixtures thereof.

Organic solvent soluble polymers and the solvents in which they dissolve are described, for example, in U.S. Pat. No. 5,989,630. Suitable organic soluble polymers may comprise, as polymerized units, 1 to 20 carbon alkyl(meth)acrylates, aromatic vinyl compounds, vinyl esters of carboxylic acids having 1-20 carbon atoms, mono(meth)acrylates of alkanediols, (meth)acrylamide, vinyl ethers of 1-20 carbon alkanols, diesters of ethylenically unsaturated dicarboxylic acids with 1-20 carbon alkanols (meth)acrylonitriles, vinyl halides and (di)olefins. Suitable solvents may comprise toluene, or a mixture of a good solvent for the polymer in question, eg. toluene, and a very poor solvent (coagulant) for the polymer, eg. n-octane; the mixture of toluene and n-octane in particular is particularly advantageous to use, the best results being obtained with a toluene to n-octane ratio which is within the range from about 5:1 to about 1:1.

The first polymer may comprise, as polymerized units, at least 50 percent by weight of nonionic mono-ethylenically unsaturated monomer and, optionally, at least one copolymerized mono-ethylenically unsaturated monomer. Such a first polymer may be formed by free radical addition polymerization. The first polymer may also be a condensation polymer, for example, a polyester, a polyurethane, or a polyamide.

The first polymer may comprise, as polymerized units, from 0.05 to 50 wt. %, preferably, 0.2 or more wt. %, or, preferably, up to 35 wt. %, more preferably from 0.5 to 25 wt. %, yet more preferably 1 to 5 wt. %, based on the total weight of monomers used to make the polymer, of multi-ethylenically unsaturated monomers.

Preferably, the core stage of a multistage first polymer comprises, as polymerized units, from 5 to 100 percent by weight, based on a weight of the core stage polymer, of one or more hydrophilic mono-ethylenically unsaturated monomer, preferably (meth)acrylic acid, and from 0 to 95 percent by weight, based on the weight of the core polymer, of at least one nonionic mono-ethylenically unsaturated monomer. Such core stage polymers can be alkali swellable acid-group containing or alkali hydrolysable polymers.

The second polymer may be any polymer having the desired $T_g$, including, but not limited to, addition (co)polymers and condensation (co)polymers. Where the second polymer is a condensation polymer, it may be grafted onto condensation reactive groups in the first polymer. For example, where the first polymer comprises amine or hydroxyl groups, the second polymer may by an urethane polymer, an alkyd or a carboxyl functional polyester; likewise, where the first polymer comprises acid groups, the second polymer may comprise a polyester polyol, a polyurethane polyol, or a hydroxyl functional polyester.

Each of the first polymer and the second polymer, independently, may contain from 0% to 7.5 wt. % and preferably from 0 wt. % to 2.5 wt. %, as polymerized units, of one or more mono-ethylenically-unsaturated acid or diacid monomer, or its anhydride, based on the total weight of monomers used to make the polymer.

Both an acid monomer and an amide monomer, as polymerized units, may be incorporated into the second polymer, such as, for example, from 0.1 to 2.5 wt. % acrylic acid and from 0.1 to 2.5 wt. % acrylamide, each based on the total weight of monomers used to make the polymer.

Suitable mono-ethylenically unsaturated monomers for the first polymer and/or the second polymer may include, for example, (meth)acrylic ester monomers including, for example, $C_1$ to $C_{30}$ (cyclo)alkyl(meth)acrylates, such as, for example methyl(meth)acrylate, ethyl methacrylate, butyl acrylate, 2-ethylhexyl(meth)acrylate, decyl acrylate, lauryl (meth)acrylate, isodecyl(meth)acrylate, hydroxyalkyl (meth) acrylates, acetoacetoxyethyl(meth)acrylate, acetoacetoxyalkyl (meth)acrylates, 2-(3-oxazolidinyl)ethyl(meth) acrylate, and amine-functional (meth)acrylates, such as tert-butylaminoethyl(meth)acrylate; (meth)acrylamide, N-alkyl (meth)acrylamides, N,N-dialkyl(meth)acrylamides; (meth) acrylonitrile; ethyleneureido-functional monomers; allyl acetoacetate; ethylene; propylene; styrene and substituted styrenes; butadiene; vinyl esters, such as vinyl acetate and vinyl butyrate; vinyl imidazole, vinyl chloride, vinyl toluene, and vinyl benzophenone; and vinylidene chloride. Preferably the first polymer and the second polymer are formed from predominantly (meth)acrylic, styrene/(meth)acrylic, or vinyl acetate/acrylic monomers; more preferably, the first polymer is formed from styrene or from all (meth)acrylic monomers. The second polymer is preferably formed from butyl acrylate, ethyl acrylate, ethyl hexyl acrylate and mixtures thereof.

Suitable mono-ethylenically unsaturated acid or diacid monomers may include, for example, (meth)acrylic acid; itaconic acid; fumaric acid; maleic acid; monoalkyl itaconates; monoalkyl fumarates; maleic anhydride; 2-acrylamido-2-methylpropane sulfonic acid; vinyl sulfonic acid; styrene sulfonic acid; 1-allyloxy-2-hydroxypropane sulfonic acid; alkyl allyl sulfosuccinic acid; sulfoethyl(meth)acrylate; phosphoalkyl (meth)acrylates, such as phosphoethyl(meth)acrylate; phosphodialkyl (meth)acrylates; and allyl phosphate. Preferred acid monomers are (meth)acrylic acid, itaconic acid, fumaric acid and maleic acid.

Suitable hydrophilic mono-ethylenically unsaturated monomers useful for making the core polymer include monomers containing acid-functionality, such as carboxylic acid group(s), including acrylic acid, methacrylic acid, acryloxypropionic acid, (meth)acryloxypropionic acid, itaconic acid, aconitic acid, maleic acid or anhydride, fumaric acid, crotonic acid, monomethyl maleate, monomethyl fumarate, and monomethyl itaconate; and monomers containing hydroxyl or amine groups. Acrylic acid and methacrylic acid are preferred.

Suitable multi-ethylenically unsaturated monomers include, for example, those having two or more ethylenically unsaturated bonds, such as, allyl methacrylate, diallyl phthalate, glycol di(meth)acrylates, such as, for example, 1,2-ethyleneglycol dimethacrylate; and divinyl benzene.

The hollow core binder of the present invention may be formed by various processes known in the art for forming an aqueous dispersion of a first polymer, and a second polymer shell substantially encapsulating the first polymer. The second polymer is polymerized in the presence of the first polymer.

Each of the first polymer and second polymer aqueous emulsion polymers may be prepared by known polymerization techniques; thus, the hollow core binders of the present invention may be formed by emulsion polymerization. For example, the hollow core binder may be formed by emulsion polymerizing a core-shell copolymer as the first polymer, adding to the aqueous emulsion polymerized core-shell copolymer and polymerizing in the presence of the core-shell polymer one or more mono-ethylenically unsaturated monomer to form the second polymer, and, further, adding a swelling agent to the aqueous dispersion prior to, during, or after the polymerization of the mono-ethylenically unsaturated monomers of the second polymer. The second polymer may be formed in the same reaction vessel or kettle as the first polymer. Alternatively, the second polymer may be formed after a period of time in a different reaction vessel or kettle, such as a holding tank or a drain tank. The polymerization temperature of the second polymer should be at least 30° C. lower than the calculated $T_g$ of the first polymer. Preferably, the process comprises polymerizing at least 10% of the mono-ethylenically unsaturated monomer of the second polymer at a temperature of from 5° C. to 65° C.

Each of the first polymer and the second polymer can, independently, comprise a multi-stage polymer or a polymer with multiple phases so long as each phase includes at least one copolymerized mono-ethylenically unsaturated monomer and each has the desired $T_g$. Preferably, each of the first polymer and the second polymer are formed by a multistage polymerization wherein the second polymer is formed in the presence of the first polymer.

In a preferred embodiment, at least 10, preferably 20, more preferably 50, and most preferably 100, weight % of the total of the second polymer is formed by polymerization at a temperature of from 5° C. to 65° C., preferably 10° C. to 50° C., more preferably 20° C. to 40° C., wherein the polymerization temperature is at least 30° C. lower than the $T_g$ of the first polymer. The temperature at which the second polymer is formed may be allowed to rise above 65° C. during the formation of the second polymer with the proviso that at least 10% of the second polymer is formed at a temperature of from 5° C. to 65° C., wherein the polymerization temperature is at least 30° C. lower than the $T_g$ of the first polymer.

In another preferred embodiment, the concentration of unpolymerized monomer in the reaction vessel is, at any time (T), is no greater than 6%, preferably, no greater than 5%, and more preferably, no greater than 4%, by weight, based on the total weight of reaction mixture present in the reaction vessel at time (T).

Each of the first and second polymer may be prepared such that surfactants, initiators, and other additives are selected independently, i.e. they may be the same or different in kind and amount for each polymer. In any emulsion polymerization process, conventional surfactants may be used, such as, for example, anionic and/or nonionic emulsifiers, such as, for example, alkali metal or ammonium salts of alkyl, aryl, or alkylaryl sulfates, sulfonates or phosphates; alkyl sulfonic acids; sulfosuccinate salts; fatty acids; ethylenically unsaturated surfactant monomers; and ethoxylated alcohols or phenols. The amount of surfactant used may range from 0.1% to 6% by weight, based on the weight of monomer used to form any polymer.

The first polymer and the second polymer may, independently, be polymerized via free radical polymerization, including, for example, thermal, redox, photochemical, and electrochemical initiation. Where reaction temperature is maintained at from 5° C. to 65° C. during the formation of at least 10% by weight of the second polymer, a redox polymerization process is preferred during that interval.

Any monomer in any polymerization may be added neat, i.e., not as an emulsion in water, or as an emulsion in water. The monomer may be added in one or more additions or continuously, linearly or not, over the reaction period, or combinations thereof. In the case of polyesters or polyamides, the reactant polyacids and polyols (or polyamines) may be polymerized in bulk in the presence of known condensation catalysts, such as trialkyl tin oxides.

Each of the first polymer and second polymer, independently, may be formed using suitable free radical initiators (oxidants) or redox catalysts. Suitable initiators may include, for example, persulfates, such as, for example, ammonium and/or alkali metal persulfates; peroxides, such as, for example, sodium or potassium hydroperoxide, t-butyl hydroperoxides, t-alkyl hydroperoxides, dicumyl hydroperoxide; t-alkyl peroxides or t-alkyl peresters, wherein the t-alkyl-group includes at least 5 carbon atoms; perboric acids and their salts, such as, for example, sodium perborate; perphosphoric acids and salts thereof; potassium permanganate; and ammonium or alkali metal salts of peroxydisulfuric acid. Such initiators may be used in amounts ranging from 0.01 wt. % to 3.0 wt. %, based on the total weight of monomers. Redox catalysts comprising one or more oxidants with a suitable reductant, may include, for example, sodium sulfoxylate formaldehyde; ascorbic acid; isoascorbic acid; alkali metal and ammonium salts of sulfur-containing acids, such as sodium sulfite, bisulfite, thiosulfate, hydrosulfite, sulfide, hydrosulfide or dithionite; formadinesulfinic acid; hydroxymethanesulfonic acid; sodium 2-hydroxy-2-sulfinatoacetic acid; acetone bisulfite; amines, such as ethanolamine, glycolic acid; glyoxylic acid hydrate; lactic acid; glyceric acid, malic acid; tartaric acid; and salts of the preceding acids may be used in amounts of 0.01 wt. % to 5.0 wt. %, based on the total weight of monomers.

Redox reaction catalyzing metal salts of iron, copper, manganese, silver, platinum, vanadium, nickel, chromium, palladium, or cobalt may be added for the formation of the first polymer and the second polymer. Typical levels of catalytic metal salts used in accordance with the invention range from 0.01 ppm to 25 ppm, and may range up to 1.0 wt. %, based on the total weight of monomers. Mixtures of two or more catalytic metal salts may also be usefully employed. Chelating ligands, which can be used with catalytic metal salts, include multidentate aminocarboxylate ligands, such as, for example, nitrilotriacetic acid (NTA, a tetradentate ligand), ethylene diamine diacetic acid (EDDA, a tetradentate ligand), N-(hydroxyethyl) ethylene diamine triacetic acid (HEDTA, a pentadentate ligand), and ethylene diamine tetraacetic acid (EDTA, a hexadentate ligand).

Chain transfer agents, such as, for example, mercaptans, such as alkyl thioglycolates, alkyl mercaptoalkanoates, and $C_4$-$C_{22}$ linear or branched alkyl mercaptans; halogen compounds, including tetrabromomethane; or mercaptocarboxylic acids may be used to control the molecular weight of the first polymer and second polymer. Chain transfer agent(s) may be added in one or more additions or continuously, linearly or not, over most or all of the entire reaction period or during limited portion(s) of the reaction period. Suitable amounts of chain transfer agents range from 0.25 to 10 wt. %, based on the total weight of monomers.

The first polymer and the second polymer may, independently, comprise single stage polymers, or they may include more than one phase, such as, for example, those formed by a multistage emulsion polymerization. Multistage emulsion polymerization can result in the formation of at least two mutually incompatible polymer compositions, and, thereby, in the formation of at least two phases within the polymer particles. Such particles are composed of two or more phases of various geometries such as, for example, core/shell or core/sheath particles, core/shell particles with shell phases partially encapsulating the core, core/shell particles with a multiplicity of cores, and interpenetrating network particles. Multistage emulsion copolymers can be formed in two or more stages, where the stages differ in molecular weight as well as composition.

Preferably, the aqueous dispersions of the present invention are formed by methods comprising providing an aqueous dispersion of multi-stage emulsion polymer comprising a core stage polymer (the "core") and a first shell stage polymer (the "first shell"), forming a second shell stage polymer (the "second shell"), which substantially encapsulates the first shell stage polymer, by adding to the emulsion of multi-staged polymer at least one mono-ethylenically unsaturated monomer and causing at least 10% of the monomer to polymerize, at a temperature of from 5° C. to 65° C., in the presence of the multi-staged polymer, wherein the temperature is at least 30° C. lower than the calculated $T_g$ of the first shell stage polymer. The core of the multi-stage emulsion polymer is caused to swell by the addition of a swelling agent to the aqueous dispersion prior to, during, or after the polymerization of the monomers comprising the second shell stage polymer. This preferred process is as described in U.S. Patent Publication No. 20010009929A.

The core stage of the first polymer, whether obtained by a single stage process or a process involving several stages, has an average particle size diameter of from 50 nm to 1.0 micron, and preferably, from 100 nm to 300 nm, in an unswollen condition. If the core is obtained from a seed polymer, such as one described in US Publication No. 20010009929, the seed polymer, preferably, has an average particle size of from 30 nm to 200 nm. The core may also optionally contain less than 20% by weight, and preferably from 0.1 to 3% by weight, based on the total weight of the core, of multi-ethylenically unsaturated monomer.

The core and shell of the preferred first polymer may themselves be comprised of more than one stage. There may also be one or more intermediate stages. Preferably, the multi-stage polymer comprises a core, an intermediate layer and a shell. The intermediate layer is described in U.S. Patent Publication No. 20010009929A.

The hollow core binder particles of the invention include a first polymer and a second polymer substantially encapsulating the first polymer. Preferably, greater than 75%, and more preferably 100%, of the surface area of the first polymer particle is covered by the second polymer. The extent of coverage or encapsulation of the polymeric particles may be determined by scanning electron microscopy, with or without staining techniques, as is known in the art.

The hollow core binder particles of the present invention have an average particle diameter of from 200 nanometers (nm) or more, and may range up to 5000 nm, preferably up to 1500 nm, more preferably, 300 nm or more or, more preferably, up to 1000 nm. Also contemplated are multimodal, i.e., bimodal or polymodal, particle size emulsion polymers.

The first polymer includes, when dry, at least one void. Preferably, void sizes range 50 nm or more, preferably 100 nm or more, and may range up to 1200 nm, preferably, up to 800 nm. In some embodiments where the inventive particles increase the opacity of films in which they are present, it is preferred that void size be in the range of from 200 to 700 nm.

Single void containing polymers formed by multistage emulsion polymerization and methods of making them are known in the art, as disclosed in U.S. Pat. Nos. 4,427,836; 4,469,825; 4,594,363; 4,970,241; 5,225,279; 5,494,971; 5,510,422; 5,527,613; 6,020,435; 6,139,961; 6,673,451; and 6,784,262; as well as in U.S. Patent Publication Nos. 20010009929A; 20010036990A; and 20030129435A.

Suitable first polymers may also contain, when dry, two or more voids, whether isolated or connected to other voids, whether substantially spherical in shape or not, including, for example, void channels, interpenetrating networks of void and polymer, and sponge-like structures, such as are disclosed, for example, in U.S. Pat. Nos. 5,036,109; 5,216,044; 5,521,253 and 5,989,630. Multiple voids may be formed within a core polymer particle fully or partially enclosed by a first polymer or in an internal stage of a multistage first polymer.

Voids may be formed by swelling the first polymer or part of a multistage first polymer particle, or by dissolving out part of or a stage of the first polymer particle e.g. via a solvent, to form, when dry, a void. Alternatively, the first polymer may include removable porogens, such as, for example, titanium dioxide and silicon oxide, which is removable with aqueous acid; fugitive substances, such as, for example supercritical carbon dioxide; or oxidizable compounds that leave voids on oxidation.

In one embodiment, a first polymer with at least one void, when dry, may be formed according to the methods as taught in U.S. Pat. No. 6,632,531, wherein the first polymer of the invention is formed in the presence of at least one fugitive substance, i.e., any substance having a normal boiling point of less than 30° C., and the second polymer of the invention is polymerized in the presence of the first polymer. In such embodiments, the second polymer may be formed either before or after the removal of the fugitive substance.

Suitable fugitive substances preferably are selected from the group consisting of supercritical carbon dioxide, 2,2-dimethylypropane, dichlorofluoromethane, 1,2-dichlorotetrafluoroethane, butane, 1,1,2,2-tetrafluoroethane, 1,1,1,2-tetrafluoroethane, dimethyl ether, 1,1-difluoroethane, octafluoropropane, chlorodifluoromethane, propane, pentafluoroethane, difluoromethane, sulfur hexafluoride, hexafluoroethane, carbon dioxide, chlorotrifluoromethane, trifluoromethane, ethane, tetrafluoromethane, methane, difluoromethane, hexafluoroethane, chlorotrifluoromethane, trifluoromethane, ethane, tetrafluoromethane, methane, and combinations thereof.

Preferably, one or more swelling agents may be used to form one or more void in the first polymer. Suitable swelling agents include those which, in the presence of a core-shell first polymer emulsion and monomer(s) used to form the second polymer, are capable of permeating the first polymer shell and swelling the core. Swelling agents may be aqueous or gaseous, volatile or fixed bases, or combinations thereof.

Suitable swelling agents include volatile bases, such as ammonia, ammonium hydroxide, and volatile lower aliphatic amines, such as morpholine, trimethylamine, and triethylamine; fixed or permanent bases, such as potassium hydroxide, lithium hydroxide, zinc ammonium complex, copper ammonium complex, silver ammonium complex, strontium hydroxide, and barium hydroxide. Solvents, such as, for example, ethanol, hexanol, octanol, Texanol® solvent and those described in U.S. Pat. No. 4,594,363, may be added to aid in fixed or permanent base penetration. Ammonia and ammonium hydroxide are preferred.

The core of the preferred multi-stage first polymer may be caused to swell by the addition of one or more swelling agent to the aqueous dispersion prior to, during, or after the polymerization of the monomers comprising the second shell stage polymer, but after the formation of the first shell polymer. Preferably, swelling agent is added to the aqueous dispersion at a time when the aqueous dispersion comprises at least 0.5 wt. %, based on the total weight of the polymer in the dispersion, of unreacted monomer under conditions where there is no substantial polymerization of the monomer; and subsequently reducing the level of monomer by at least 50%. The phrase "under conditions wherein there is no substantial polymerization of the monomer" and the techniques for achieving such conditions are as described in U.S. Patent Publication No. 20010009929A.

Preferably, the amount of swelling agent is in the range of from 75 to 300%, and more preferably in the range of from 90 to 250%, based on the equivalents of the functionality in the core capable of being neutralized. It is also preferable to add the one or more swelling agents to the multistage emulsion polymer while the multistage emulsion polymer is at an elevated temperature, preferably at a temperature within 10° C. of the shell polymerization temperature. Swelling is generally very efficient, i.e., swelling in minimum amount of time under conditions of elevated temperature in the presence of monomer and no substantial polymerization occurring. Under these conditions, swelling is generally complete within 30 minutes, preferably within 20 minutes, and most preferably within 10 minutes, of adding the one or more swelling agents.

After swelling the preferred multistage emulsion first polymer in the presence of the monomer used to form the second polymer and swelling agent, it is desirable to reduce the level of monomer to less than 10,000 ppm, and preferably to less than 5,000 ppm, based on polymer solids. This can be accomplished by any suitable means. Preferably, the level of monomer is reduced by polymerizing the monomer. This can be accomplished by any suitable means, such as by adding one or more initiators recited above. It is preferred to begin to reduce the level of monomer within 20 minutes, and more preferably within 10 minutes, of adding the one or more swelling agents.

In one embodiment, the first polymer comprises an organic solvent soluble polymer as a core stage or as the whole first polymer, and voids may be formed by solution polymerization either of the first polymer or a polymer comprising 5 to 100 wt. %, as polymerized units, of a hydrophilic monoethylenically unsaturated monomer in a water-immiscible solvent or solvent mixture, subsequent solution polymerization of the reactants to make the other of the first polymer and the polymer comprising, as polymerized units, hydrophilic mono-ethylenically unsaturated monomer, in the resulting polymerization solution, dispersing the solution comprising the first polymer and the second polymer in water in the presence of a base, and distillative removal of the organic solvent down to a concentration of less than 5% by weight, based on the amount of the dispersion, replacing the solvent with water. The second polymer can then be emulsion polymerized in the presence of the aqueous dispersion to make the hollow core binder of the present invention, with subsequent drying of the dispersion. The dry dispersion can be re-dispersed in water in the presence of a base, e.g. ammonia. Suitable solvents include aromatic hydrocarbons, eg. toluene; aliphatic hydrocarbons, eg. n-hexane, n-octane; or cycloaliphatic hydrocarbons.

In embodiments wherein the first polymer comprises an alkali hydrolysable cores or inner stage, voids may be formed by exposing the aqueous dispersion of the first polymer to a strong alkaline solution, such as sodium hydroxide, in an amount of from about 0.75 to about 1.5 equivalents of base, based on all the acids in the shell phases and the more easily hydrolysable acrylate esters in the core or inner stage, such as methyl acrylate. The expansion of the hollow latexes should occur at from 100° C. to 150° C.; preferably, from 110 to 140° C. When the crosslinking density of the shells is greater, the temperature of the expansion step should also be greater. Solvents can aid the swelling in the expansion step. The expansion time can range from about 0.5 to about 10 hours; preferably from about 2 to about 5 hours.

The aqueous dispersion of hollow core binder particles may have a solids content of greater than 30%, and preferably, greater than 40%, by weight. Addition of polymer particles having a particle size smaller than the hollow core binder particles may produce dispersions with solids content approaching 70% or more. A high solids content, or the presence of smaller particles, or combinations of both, may prevent settling or sedimentation of the inventive particles.

The present invention provides an aqueous coating composition suitable for use, when dry, as a coating for paperboard, the coating composition comprising the hollow core binder, binder, e.g. styrene butadiene (S/B) latex, titanium dioxide or opacifying pigment, and other pigment or filler, e.g. clay. In relatively low PVC coating formulations, the hollow core binder forms a continuous film in which the other components, including pigments and extenders, are embedded. In relatively high PVC formulations, the hollow core binder reduces the amount of opacifier or binder needed to achieve a desired opacity or film strength. Accordingly, pigmented coating formulations comprising the inventive polymer particles as binders may provide opacity, brightness and strength equal to formulations comprising higher proportions non-voided polymer particles as binder and higher proportions of Opacifiers. Thus, a formulator may achieve a desired level of opacity in coating formulations using the hollow core binder of the present invention by using a lower level of pigment and/or extender than would be required to achieve the same level of opacity in a comparable formulation using non-voided polymer particles as binder. Further, hollow core binder may be used advantageously in papermaking.

The coating compositions of the present invention may contain from 2 to 22 wt. %, based on the dry weight of the pigment in the paperboard coating, of hollow core binder, preferably, from 3 to 7 wt. %.

Suitable binders used in paperboard coatings may be a natural or synthetic polymer in the form of a solution or dispersion in water such as, for example, starch, hydroxyethylated starch, protein, polyvinyl acetate, poly(styrene/acrylate) and poly(styrene/butdiene). The binder particles are of such character as to be film-forming at the temperature at which the formulation is dried. Alternately, solvents or coalescents may be added to soften binder particles as to cause them to be film-forming. Binder proportions are reduced relative to conventional coating compositions, and may be used at a total level of 1.4 to 20 wt. %, when dry, based on the weight of dry pigment, preferably, 7 wt. % or more and up to 15 wt. %, more preferably, 10 wt. % and up to 14 wt. %.

In general, the aqueous coating compositions may contain up to 75 wt. %, preferably, 5 to 50 wt. %, and more preferably, 5 to 35 wt. %, based on the total weight of polymers used, of one or more emulsion polymer binder not containing voids or an emulsion polymer non-film former, such as a matting agent.

Aqueous coating composition may contain conventional coating additives, such as, for example, tackifiers, pigments, extenders, emulsifiers, crosslinkers, coalescing agents, buffers, neutralizers, thickeners or rheology modifiers, humectants, wetting agents, biocides, plasticizers, antifoaming agents, colorants, waxes, and anti-oxidants. Unless otherwise indicated, such additives may be used in conventional amounts.

Examples of suitable pigments and extenders for use in the formulation of coatings include clay, such as kaolin and delaminated clay, and/or calcium carbonate, but other inorganic or organic pigments may be included such as, for example, calcined clay, titanium dioxide, such as anatase and rutile titanium dioxides, calcium carbonate, and solid polystyrene particles and hollow plastic pigments. The total amounts of pigment and extender in the aqueous coating composition vary, but may range from 60-90 wt. %, based on the total solids of the composition, preferably from 65 to 80 wt. %, more preferably, from 65 to 75 wt. %. As part of the total pigments used, titanium dioxide, or opacifier-glossing additives, such as hollow plastic pigments, and/or glossing additives, such as solid polystyrene particles, are reduced relative to conventional coating compositions and may comprise 7 to 30 wt. %, based on the total solids of the composition, preferably from 12 to 28 wt. %, more preferably, from 15 to 25 wt. %. In bleached paperboard coatings, no opacifier need be used.

Preferably, the aqueous coating composition contains less than 5 wt. % VOC, more preferably less than 3 wt. % VOC, and even more preferably less than 1.7 wt. % VOC by weight, all wt. % s based on the total weight of the aqueous coating composition. Coating formulations may comprise VOCs in the aqueous dispersion of polymeric particles, biocides, defoamers, soaps, dispersants, and thickeners, each of which preferably accounts for 0.1 wt. % VOC, based on the total weight of the aqueous coating composition. Additional methods such as, for example, steam stripping of the aqueous dispersion of polymeric particles and selection of low VOC containing additives, such as biocides, defoamers, soaps, dispersants, and thickeners, may be used to further reduce the paint or coating to less than 0.01% VOC by weight, based on the total weight of the aqueous coating composition.

Aqueous paperboard coating compositions may be prepared by techniques known in the coatings art and are prepared generally by simply mixing the ingredients. For example, to make pigmented aqueous coating compositions, the pigment may be dispersed in an aqueous medium under high shear, such as with a COWLES® mixer, followed by adding the aqueous dispersion of polymeric particles under lower shear stirring, along with other coating additives, as desired. Alternatively, the aqueous dispersion of polymeric particles may be included in the pigment dispersion step. The viscosity of the coating composition may range from 1000 centipoise to 5000 centipoise, as measured using a Brookfield viscometer (Model LVT using spindle #3 at 12 rpm and 25° C.); the viscosities appropriate for different application methods vary considerably and are known in the art.

The solids content of the aqueous coating composition may be from 30% to 70 wt. %, preferably from 40 to 52 wt. %, more preferably from 42 to 46 wt. %.

Suitable substrates may include, for example, recycled and unbleached paperboard, and bleached paperboard, decorative laminate paper and wet-end paper pulp or wet-end paper sheets, including natural cellulosic, recycled or synthetic fiber pulp or sheets formed therefrom. In the case of bleached paperboard, no opacifier need be used and the amount of binder ranges from 10 to 20 wt. %, based on the total solids of the composition. The phrase "paper laminate" means paper comprising two or more paper layers or lamina.

Coated paperboard is paperboard which has a waterborne coating applied to one or both sides. The uncoated paper or paperboard substrate typically may have a basis weight of 20-350 g./m$^2$ and multiple coatings, such as one or more of each of a base coat, middle coat and/or top coat) may be applied in an amount, per side, of 4-30 g/m$^2$ using conventional coatings methods such as, for example, a trailing blade coater, a size press, and an air knife coater. To avoid coating placement problems associated with paperboard substrates, coatings may be made on polyester films by using a Meyer Rod to obtain a desired thickness of the coatings.

In another embodiment, methods for improving the strength and opacity of paper or paperboard comprises combining the aqueous coating compositions of the present invention with the paper forming mixture in the wet-end before the formation of or during, i.e. combining with wet sheets, the formation of the sheet or the board from the fiber, such as by pressing or calendering.

In yet another embodiment, during the wet-end formation of a paper laminate, such as a decorative laminate paper, a composition comprising the hollow core binder polymer and at least one pigment is either (i) combined in an amount useful for making paperboard coatings with an aqueous fiber pulp slurry which is then formed into a wet layer, either a sheet or a board that contains the hollow core binder or, (ii) alternatively, is applied in an amount useful for making paperboard coatings to one or more laminate layers or wet sheets or boards formed from an aqueous fiber pulp slurry. One or more additional wet layers, either sheets or boards, of paper are formed, each one either with or without hollow core binder. The wet paper layers are then calendered or pressed together to form a laminate and are then dried. The dried laminates may then be at least partially, and, preferably, completely impregnated with a crosslinking resin. Pressure and heat are applied to the crosslinking resin-impregnated laminate paper, causing the resin to cure and harden, forming a laminate or a decorative laminate. Any suitable pigment may be used in the hollow core binder composition, however titanium dioxide is preferred. Suitable crosslinking resins include, for example, thermosetting resins containing phenoplasts and aminoplasts, such as, for example urea formaldehyde and melamine formaldehyde, and the like. Laminated paper may be heated in the range of from 100° C. to 300° C., preferably from 125° C. to 250° C., more preferably from 140° C. to 200° C. to cure the crosslinking resin. The resulting paper laminate has improved opacity, above that obtainable in a decorative laminate prepared utilizing only a pigment, as well as lower cost, where a costly pigment, such as titanium dioxide, is used. Additionally, the decorative laminate paper may be formed, and coated with a composition containing the hollow core binder and at least one pigment, both before or after drying the paper.

The aqueous compositions coated on any substrate may be dried, or allowed to dry, at a temperature from 5° C. to 95° C.

The following examples illustrate the present invention. In the examples, the following abbreviations have been used:

BA is Butyl Acrylate;
MMA is Methyl Methacrylate;
MAA is Methacrylic Acid;
t-BHP is t-Butyl Hydroperoxide (70%);
SDS is Sodium Dodecylbenzenesulfonate (23%);
DI is Deionized;
SPS is Sodium Persulphate;
ALMA is Allyl Methacrylate;
L is liter; wt is weight; vol is volume; g is gram; and min is minute.

Test Methods

Kubelka-Munk Scattering Coefficient (S/Mil) Determination: An aqueous dispersion was drawn down over a black vinyl scrub chart to form a wet film, which was dried at 30% relative humidity. S was determined on the dry film (~2 mil or ~50 microns thick) by the method of P. B. Mitton and A. E. Jacobson (Off. Digest, September 1963, p. 871-911). A scattering coefficient per unit thickness (S/μm and S/mil) was measured using a Y-reflectometer with a 45/0 geometry. A Y-reflectometer is a light reflectance meter that measures the Y component of the XYZ color scale; and A 45/0 geometry indicates that the light is incident to the coating at an angle of 45 degrees from normal, and that the scattered light is collected at an angle of 0 degrees from normal.

Particle size: Measurements were made by CHDF using Matec CHDF-2000 (capillary hydrodynamic fractionation); Matec Applied Sciences, Northborough, Mass., and A BI-90 particle size analyzer, Brookhaven Instruments Corp. (Holtsville, N.Y.)

Gloss or Sheet Gloss, unless otherwise indicated, was measured at a 75° angle using a Technidyne T480 Glossmeter (Technidyne, New Albany, Ind.). The test method for measuring gloss was TAPPI test method T-480, published in *Tappi Test Methods,* 1994-1995 by Tappi Press (Atlanta, Ga.).

Brightness was measured using a Technidyne Brightmeter Model S4-M (Technidyne, New Albany, Ind.). The test method for measuring the brightness was Tappi Test Method T-452, published in *Tappi Test Methods,* 1994-1995 by Tappi Press (Atlanta, Ga.).

PPS Smoothness was measured with a parker Print-Surf roughness tester (Model No. ME-90) made by Messmer Buchel, Inc. (Kent, United Kingdom).

IGT Pick was measured on an IGT A2 printer (IGT/Reprotest, The Netherlands) at room temperature using the following as the standard settings: Spring B, 50 kgf (kg force) and # 3, 4 or 5 tack black offset inks obtained from Sun Chemicals (Menomonee Falls, Wis.).

EXAMPLE

In Example 1 below, the polymer core used in the preparation of the hollow core binder comprised a 66 MMA/34 MAA wt. % polymer core prepared via aqueous emulsion polymerization according to U.S. Pat. No. 6,020,435. The polymer core polymerization product was filtered to yield a filtered dispersion having a solids content of 31.5 wt. % an average particle size of 139 nm.

Example 1

Preparation of Unswollen First Polymer

A 5 L, four necked round bottom flask was equipped with paddle stirrer, thermometer, nitrogen inlet, and reflux condenser. DI water, 950 g, was added to the kettle and heated to 89° C. under a nitrogen atmosphere. To the heated kettle water was added 6.0 g of sodium persulfate dissolved in 30 g of DI water. This was immediately followed by 397 g of the polymer core. A monomer emulsion (ME I) which was prepared by mixing 125 g of DI water, 8.3 g of SDS (sodium dodecyl benzene sulfonate, 23%), 125.0 g of styrene, 110.0 g of MMA, and 15.0 g of MM was added to the kettle over a period of 60 min at a temperature of 78° C. After adding ME I, a second monomer emulsion (ME II) was prepared by mixing 500 g of DI water, 22.5 g of SDS (23%), 1462.5 g of styrene, 22.5 g of methacrylic acid, 7.5 g of linseed oil fatty acid (LOFA), and 18.8 g of divinyl benzene (80% active). Monomer Emulsion II (ME II) was added to the kettle along with a separate mixture of 1.6 g of sodium persulfate dissolved in 90 g of DI water over 60 min. The temperature of the reaction mixture was allowed to increase to 92° C. Upon completion of the ME II and co-feed, the reaction mixture was held for 30 min at 85° C. and then cooled to room temperature and filtered to remove any coagulum formed. The final unneutralized latex had a solids content of 45.5%, an average particle size of 375 nm, and a pH of 2.2.

Example 2

Formation of Aqueous Dispersion of Polymeric Particles

Using the same equipment as in Example 1, 1318.7 grams of the first polymer of Example 1 along with 220 g of DI water was added to the kettle and the temperature was adjusted to 25° C. A monomer emulsion (ME I) was prepared by mixing 306 g of DI water, 17.0 g of SDS, 416.4 g of MMA, 12.0 g of MM, and 591.6 g of BA. With the kettle temperature at 25° C., a solution of 20 g of 0.1% ferrous sulfate mixed with 2 ™ g of 1% tetrasodium ethylenediamine tetraacetate, available as Versene (Dow Corp., Midland Mich.), was added to the kettle. Next, co-feeds including a solution of 3.7 g of t-BHP (70%) mixed with 100.0 g of DI water, along with a separate solution of 2.6 g of iso-ascorbic acid mixed with 100.0 g of DI water were both added to the kettle at a rate of 1.2 g/min. Two minutes after the start of the co-feed solutions, ME I prepared previously was added to the kettle at a rate of 15 g/min. There was no external heat applied to the reaction. The temperature of the kettle was allowed to increase over the duration of the ME feed. After 30 minutes, the ME I feed rate was increased to 30 g/min. Upon completion of ME I the co-feeds were stopped and the reaction was held for 5 min. The temperature of the reaction at this point was 78° C. Next, 400 g of hot DI water (90° C.) was added to the kettle. A second monomer emulsion (ME II) was prepared by mixing 54 g of DI water, 3.0 g of SDS, 75.6 g of MMA, 104.4 g of BA and 2.5 g of 4-hydroxy TEMPO (4-hydroxy 2,2,6,6-tetramethyl piperidinyloxy radical), and was added to the kettle at a rate of 40 g/min until completion. Immediately after completion of the ME II feed, 40 g of ammonium hydroxide (28%) mixed with 40 g of DI water was added to the kettle. The reaction was held for 5 min. The co-feed solutions were then resumed at a rate of 1.2 g/min until their completion. The dispersion was then cooled to 25° C. and filtered to remove any coagulum. The filtered dispersion had a solids content of 45.5%, and an average particle size of 480 nm. The Kubelka-Munk scattering coefficient was measured on the dried polymer film and found to be 40.6 S/μm (1.60 S/Mil).

Example 3

Formation of Aqueous Dispersion of Polymeric Particles

Using the same equipment as in Example 1, 1055 g of the first polymer of Example 1 along with 180 grams of DI water was added to the kettle and the temperature was adjusted to 25° C. A monomer emulsion (ME I) was prepared by mixing 367 g of DI water, 20.4 g of SDS, 499.7 g of MMA, 14.4 g of MM, and 709.9 g of BA. With the kettle temperature at 25° C., a solution of 20 g of 0.1% ferrous sulfate mixed with 2 g of 1% Versene ™ (Dow Corp.) was added to the kettle. Next, co-feeds including a solution of 4.5 g of t-BHP (70%) mixed with 120.0 g of DI water, along with a separate solution of 3.2 g of iso-ascorbic acid mixed with 120.0 g of DI water were both added to the kettle at a rate of 1.0 gram/min. Two minutes after the start of the co-feed solutions, ME I prepared previously was added to the kettle at a rate of 10.0 grams/minute. There was no external heat applied to the reaction. The temperature of the kettle was allowed to increase over the duration of the ME feed. After 30 min, the ME I feed rate was increased to 20 g/min. Upon completion of ME I the co-feeds were stopped and the reaction was held for 5 min. Next, 525 grams of hot DI water (90° C.) was added to the kettle. A second monomer emulsion (ME II) which was prepared by mixing 65 grams of DI water, 3.6 g of SDS, 90.7 g of MMA, 125.3 g of BA and 3.0 g of 4-hydroxy TEMPO, was added to the kettle at a rate of 40 g/min until completion. Immediately after completion of the ME II feed, 48 g of ammonium hydroxide (28%) mixed with 48 g of DI water was added to the kettle. The reaction was held for 5 min. The co-feed solutions were then resumed at a rate of 1.0 g/min until their completion. The dispersion was then cooled to 25° C. and filtered to remove any coagulum. The filtered dispersion had a solids content of 45.7%, and an average particle size of 540 nm. The Kubelka-Munk scattering coefficient was measured on the dried polymer film and found to be 29.7 S/μm (1.17 S/Mil).

Examples 4-13

Paperboard Coatings

In the following examples, the paperboard coatings were made and applied as laboratory draw-downs using wire-wound rods. Examples 8 and 9 were applied at Omnova, Inc.'s Akron, Ohio pilot coater facility with a conventional air knife coater. The basestock used in the lab draw-downs was pre-coated recycled paper board and/or pre-coated solid-unbleached-sulfite (SUS) board.

Examples 4, 5, 6, and 7 were hand-drawn using a Mayer wire-wound rod # 12 (Buschman Corp (Cleveland, Ohio)) such that the coat weight was around 17.8-19.2 grams/sq. meter (12-13 lbs/3300 square feet).

The pilot trials run for Examples 8 and 9 were run on 14 pt (0.03556 cm thickness (0.014 inches)), (circa) 222 g/m$^2$ (45.5 lb/1000 sq ft) or) SUS (solid unbleached sulfite) base board and coated at 364 m/min (1200 fpm) with coating solids at 59 wt. % for the basecoat and at 212 m/min (700 fpm at 49 wt % solids for the topcoat. Each roll was precoated using a standard base-coat formulation Gen Flo™ 5128 SB styrene-butadiene latex binder (Omnova, Akron, Ohio), and topcoated with the coating indicated in Table 1, below, and calendered later in a separate pass at 364 m/min (1200 fpm), at ambient temperature, and minimum calendering pressure in order to keep the gloss down to the target range of circa 45-50 units.].

IGT dry pick tests were performed on post-calendared paperboard samples with an A2 tester (IGT/Reprotest, The Netherlands) using ink tacks #4 and #5 and 1×9" [2.5 cm×23 cm] strips of coated board samples. All hand-drawn coatings were calendared at 54.4° C. (130° F.), 206.8 kN/m$^2$ (30 psi) and 182 m/min (600 ft/min). The inventive Examples were relatively more glossy and were calendared on a laboratory calendar at 37.7 TO 41.6° C. (100-107° F.), 124-193 kN/m$^2$ (18-28 psi) and 162-198 m/min (530-650 ft/min).

TABLE 1

Coatings

| | EXAMPLE | | | | | |
|---|---|---|---|---|---|---|
| | 4 | 5 | 6 | 7 | 8 | 9 |
| | Hollow Core Binder | | | | | |
| | None Parts Wt. | None Parts Wt. | Example 2 Parts Wt. | Example 3 Parts Wt. | None Parts Wt. | Example 2 Parts Wt. |
| Kaolin Clay[1] | 65 | 73 | 73 | 73 | 67 | 77 |
| $TiO_2$ | 35 | 27 | 27 | 27 | 33 | 23 |
| Hollow Core Binder | | | 10 | 10 | | 7 |
| Vinyl acetate-Acrylate binder[2] | 20 | 20 | 10 | 10 | | |
| Styrene-Butadiene binder[3] | | | | | 14 | 10 |
| Alkali Swellable Acrylic Emulsion Thickener[4] | 0.2 | 0.2 | 0.1 | 0.1 | | |
| Soy Protein Binder[5] | 3.5 | 3.5 | 3.5 | 3.5 | 3.5 | 3.5 |
| Coating Solids (%) | 48 | 48 | 48 | 48 | 48 | 48 |

[1]Hydrafine ™ No. 1, JM Huber, Edison, NJ.;
[2]POLYCO ™ P-3103NP Binder, Rohm and Haas Company, Philadelphia, PA.;
[3]Gen Flo ™ 5128, Omnova, Akron, OH.;
[4]ACRYSOL ™ Ase-75 Thickener, Rohm and Haas Company, Philadelphia, PA.; and,
[5]Procote 400, DuPont, Wilington, DE.

TABLE 2

Properties of Coatings

| EXAMPLE | Sheet Gloss | | Brightness | | PPS Smoothness | | IGT Pick | |
|---|---|---|---|---|---|---|---|---|
| # | Ave | Sd | Ave | Sd | Ave | Sd | Ave | Sd |
| 4 | 56.3 | 0.9 | 81.6 | 0.43 | 1.6 | 0.1 | 219 | 9 |
| 5 | 55.4 | 1.1 | 79.5 | 0.46 | 1.6 | 0.1 | 251 | 21 |
| 6 | 57.1 | 1.1 | 81.5 | 0.41 | 1.5 | 0.1 | 272 | 30 |
| 7 | 57.3 | 0.7 | 80.7 | 0.40 | 1.5 | 0.1 | 296 | 24 |
| 8 | 47.0 | 1.2 | 85.1 | 0.2 | 2.0 | 0.1 | 100 | 6 |
| 9 | 45.5 | 0.8 | 84.6 | 0.1 | 2.0 | 0.2 | 100 | 0 |

As shown in Examples 6 and 7, coatings made with the hollow core binder of the present invention provide equal or better coating properties than coatings of Examples 4 and 5 having twice the binder and, in the case of Example 4, 30% more titanium dioxide. As shown in Example 9, coatings made with the hollow core binder of the present invention provide equal or better coating properties than coatings of Example 8 having 40% more binder and 42% more titanium dioxide.

TABLE 3

Coatings

| | EXAMPLE | | | |
|---|---|---|---|---|
| | 10 | 11 | 12 | 13 |
| | Hollow Core Binder | | | |
| | Comparative Parts | Comparative Parts | Example 2 Parts | Example 3 Parts |
| Kaolin Clay[1] | 75 | 83 | 83 | 83 |
| $TiO_2$ | 25 | 17 | 17 | 17 |
| Hollow Core Binder | 0 | 0 | 10 | 10 |
| Vinyl acetate-Acrylate binder[2] | 20 | 20 | 10 | 10 |
| Alkali Swellable Acrylic Emulsion Thickener[3] | 0.1-0.2 | 0.1-0.2 | 0.1-0.2 | 0.1-0.2 |
| Soy Protein Binder[4] | 3.5 | 3.5 | 3.5 | 3.5 |
| Coating Solids (%) | 48 | 48 | 48 | 48 |

[1]Hydrafine ™ No. 1, JM Huber, Edison, NJ.;
[2]POLYCO ™ P-3103NP Binder, Rohm and Haas Company, Philadelphia, PA.;
[3]ACRYSOL ™ Ase-75 Thickener, Rohm and Haas Company, Philadelphia, PA.; and,
[4]Procote 400, DuPont, Wilington, DE.

TABLE 4

| Post-Calender Coating Properties | | | | | | | | |
|---|---|---|---|---|---|---|---|---|
| EXAMPLE | Sheet Gloss | | Brightness | | PPS Smoothness | | IGT Pick | |
| # | Ave | Sd | Ave | Sd | Ave | Sd | Ave | Sd |
| 10 | 54.9 | 1.2 | 79.1 | 0.4 | 1.5 | 0.1 | 221 | 32 |
| 11 | 53.9 | 1.1 | 77.1 | 0.4 | 1.5 | 0.1 | 229 | 16 |
| 12 | 53.9 | 1.5 | 79.2 | 0.4 | 1.5 | 0.1 | 291 | 11 |
| 13 | 54.8 | 1.1 | 78.2 | 0.4 | 1.5 | 0.1 | 307 | 7 |

As shown in Examples 12 and 13, coatings made with the hollow core binder of the present invention provide equal or better coating properties than coatings of Examples 10 and 11 having twice the binder and, in the case of Example 10, 40% more titanium dioxide.

I claim:

1. A paperboard article having thereon a coating comprising one or more hollow-core binder of a first polymer containing one or more void, the said first polymer being substantially encapsulated by a second polymer, wherein one or both of the said first polymer and the said second polymer is formed from, as polymerized units, one or more ethylenically unsaturated monomer, further, wherein the said second polymer has a glass transition temperature ($T_g$) ranging from more than −5° C. and up to and including 30° C., and, still further, wherein the weight ratio of the said second polymer to the said first polymer ranges from 1:1 to 4:1.

2. A paper or a paper laminate comprising cellulosic fiber pulp, filler and one or more hollow-core binder in one or more layer of the said paper laminate, the said hollow-core binder comprising a first polymer containing one or more void, the said first polymer being substantially encapsulated by a second polymer, wherein one or both of the said first polymer and the said second polymer is formed from, as polymerized units, one or more ethylenically unsaturated monomer, further, wherein the said second polymer has a glass transition temperature ($T_g$) ranging from more than −5° C. and up to and including 30° C., and, still further, wherein the weight ratio of the said second polymer to the said first polymer ranges from 1:1 to 4:1.

3. A coated paperboard as claimed in claim 1, wherein the said second polymer of the said hollow core binder is formed from, as polymerized units, butyl acrylate, ethyl acrylate, ethyl hexyl acrylate and mixtures thereof.

4. A paper or a paper laminate as claimed in claim 2, wherein the said second polymer of the said hollow core binder is formed from, as polymerized units, butyl acrylate, ethyl acrylate, ethyl hexyl acrylate and mixtures thereof.

5. A coated paperboard as claimed in claim 1, wherein the $T_g$ of the said first polymer is 50° C. or more and the said first polymer of the said hollow core binder comprises a multi-stage polymer formed from, as polymerized units, one or more ethylenically unsaturated monomer and having a void containing core stage.

6. A paper or a paper laminate as claimed in claim 2, wherein the $T_g$ of the said first polymer is 50° C. or more and the said first polymer of the said hollow core binder comprises a multi-stage polymer formed from, as polymerized units, one or more ethylenically unsaturated monomer and having a void containing core stage.

7. A method for forming a coated paperboard comprising applying a coating composition to a paperboard substrate, the coating composition comprising an aqueous dispersion of one or more hollow-core binder of a first polymer containing one or more void, the said first polymer being substantially encapsulated by a second polymer, wherein one or both of the said first polymer and the said second polymer is formed from, as polymerized units, one or more ethylenically unsaturated monomer, further, wherein the said second polymer has a glass transition temperature ($T_g$) ranging from more than −5° C. and up to and including 30° C. and, still further, wherein the weight ratio of the said second polymer to the said first polymer ranges from 1:1 to 4:1; and, drying and/or curing to form a coating.

8. A method for forming a coated paperboard as claimed in claim 7, wherein the said coating composition further comprises one or more binder polymer, one or more opacifying pigment, or mixtures therof.

9. A method for forming a coated paperboard as claimed in claim 7, wherein the said weight ratio of the said second polymer to the said first polymer in the said hollow core binder ranges from 2:1 to 3:1.

* * * * *